US005961908A

United States Patent [19]

Reinehr et al.

[11] Patent Number: 5,961,908

[45] Date of Patent: Oct. 5, 1999

[54] APPARATUS AND A PROCESS FOR THE PRODUCTION OF ELASTANE FILAMENTS

[75] Inventors: Ulrich Reinehr, Dormagen; Tilo Sehm, Düsseldorf; Wolfgang Anderheggen; Toni Herbertz, both of Dormagen, all of Germany

[73] Assignee: Bayer Faser GmbH, Dormagen, Germany

[21] Appl. No.: 09/040,789

[22] Filed: Mar. 18, 1998

[30] Foreign Application Priority Data

Apr. 15, 1997 [DE] Germany ..... 197 15 584

[51] Int. Cl.[6] ..... D01D 5/06; D01F 6/70; D01F 6/72

[52] U.S. Cl. ..... 264/169; 264/184; 366/336; 425/67; 425/192 S; 425/198; 425/382.2; 425/464

[58] Field of Search ..... 264/169, 184; 425/67, 192 S, 198, 382.2, 464; 366/336

[56] References Cited

U.S. PATENT DOCUMENTS

| | | | |
|---|---|---|---|
| 3,526,689 | 9/1970 | Jones et al. | 264/103 |
| 4,201,482 | 5/1980 | Imhauser et al. | 366/98 |
| 4,361,489 | 11/1982 | Kilsdonk et al. | 425/464 X |
| 5,601,854 | 2/1997 | Schroeder et al. | 425/192 S |

FOREIGN PATENT DOCUMENTS

| | | |
|---|---|---|
| 2522106C3 | 11/1976 | Germany . |
| 2822096C2 | 11/1979 | Germany . |
| 4446340C1 | 5/1996 | Germany . |

OTHER PUBLICATIONS

U.S. Patent Application Serial No. 08/572,991 filed Dec. 15, 1995.

A. Heierle, et al. Statische Mischer Für Die Chemiefaser–Industrie Chemiefasern/Textilindustrie, 43./95. Jahrgang, Sep. 1993 pp. 669–6674.

Franz Fourné, Polymerisation und Spinnsysteme zur Herstellung von Elastangarnen Chemiefasern/Textilindustrie 44/96th vol. Year, p. 365 (1994).

R. Kaiser/G. Gottschalk, Elementare Tests zur Bearbeitung von Messdaten (Elementary Tests for the Processing of Measured Data). B.I. Hochschultaschenbücher, vol. 774, p. 60 (Undated).

Franz Fourné, Konstruktiondetails Für Nassspinnanlagen Synthetiche Fasern, 1995, pp. 501–505.

Franz Fourné, Schmelze–Und Lösungfilter Synthetische Fasern, 1995, pp. 322–329.

Franz Fourné, Chemiefasern/Textilindustrie 44/96th vol. Year, 1994, p. 394.

*Primary Examiner*—Leo B. Tentoni

*Attorney, Agent, or Firm*—Sprung Kramer Schaefer & Briscoe

[57] ABSTRACT

A spinning noxxle apparatus for the production of elastane filaments from spinning solutions by the wet spinning method comprising a feed line (7) for the spinning solution, a filter unit (1) having a mixer element (2) and a filter element element (3), a spinning nozzle (5) for immersion in a precipation bath (11), and a connection piece (8) for the direct connection of the filter unit (1) and spinning nozzle (5), wherein the spinning nozzle (5) is joined to the connection piece (8) by a quick-release coupling connection (4), particularly a bayonet coupling (4).

12 Claims, 2 Drawing Sheets

APPARATUS AND A PROCESS FOR THE PRODUCTION OF ELASTANE FILAMENTS

BACKGROUND OF THE INVENTION

This invention relates to an apparatus and a process for the production of elastane filaments by the wet spinning method, with improved titer uniformity of the elastane filaments and an increased service life of the spinning nozzles.

Elastane filaments are currently mainly produced by two methods which are fundamentally different, namely the dry spinning method and the wet spinning method. In the dry spinning method, the spinning solvent of a solution of a polyurethane, typically in dimethylacetamide, is removed from the filaments which are spun in the spinning shaft, by hot gas in the spinning shaft and by heating the spinning shaft. In the wet spinning method for the production of elastane filaments, the elastane solution to be spun is generally pre-filtered after a degassing step and is transferred into a spinning vessel. The polymer solution is subsequently filtered, and after the optional further addition of additives the spinning solution is fed to spinning nozzles by means of metering pumps. This procedure is described, for example, by F. Fourné in Chemiefasern/Textilindustrie 44/96th Volume Year, page 365, and in U.S. Pat. No. 3 526 689.

Elastane solutions are understood to be solutions of polyurethanes or polyurethane-ureas, which are usually structured in a segmented manner from hard and soft segments, in suitable solvents such as dimethylacetamide or dimethylformamide. Depending on the area of application, polyester or polyether chains are usually incorporated in the polyurethane(-ureas) as the soft segments.

In wet spinning, the spinning nozzles are immersed in a spinning bath, whereupon the spinning solution which emerges through the orifices of each spinning nozzle coagulates when it enters the spinning bath (precipitation bath). This produces filaments which are subsequently pulled off and fed to a further treatment step. During the wet spinning of elastane filaments, in addition to the complete de-aeration of the solution which is ready for spinning, good uniformity and filtration are important prerequisites for a perfect spinning process (see F. Fourné: Chemiefasern/Textilindustrie 44/96th Volume Year, June 1994, page 394, left-hand column, 2nd paragraph).

When these process steps, which are known in principle, are adhered to, a maximum nozzle service life of about 2–3 days is generally achieved. The nozzles then start to become clogged by elastane material, and this results in filament tear-off effects in the precipitation bath and in filaments becoming wound on the deflection rolls in the immersion bath or at other production locations. The nozzles then have to be replaced, which is associated with a relatively high time consumption for the operating personnel. This time consumption is generally 3 to 5 minutes per spinning nozzle. This results in increased costs during the wet spinning operation.

Amongst their other uses, threads made of elastane filaments are employed for the production of sheet goods, woven fabrics or materials which in turn are mainly suitable for corsetry, stockings and elastic sports clothing such as bathing suits or bathing trunks.

In general, wet-spun elastane filaments exhibit good titer uniformity, with a coefficient of variation of the titer which is less than 5. However, these values are often unsatisfactory, particularly for the production of textile broadware. What are termed "baggy" regions are then formed in ready-to-wear goods, and generally result in complaints by customers.

SUMMARY OF THE INVENTION

The object of the present invention was to develop a spinning apparatus with an extended nozzle service life and thereby considerably to increase both the yield and the filament quality of wet-spun elastane filaments compared with the spinning apparatuses which are known from the prior art.

It has been found that both the filament quality of the elastane filaments and the nozzle service life can be considerably improved if an easily replaceable, so-called "nozzle package" is used for wet-spinning instead of a conventional spinning nozzle.

DETAILED DESCRIPTION

The present present relates to a spinning nozzle apparatus for the production of elastane filaments from spinning solutions by the wet-spinning process, comprising a feed line for the spinning solution, a filter unit comprising a mixer element and a filter element, a spinning nozzle for immersion in a precipitation bath, and a connection piece for the direct connection of the filter unit and spinning nozzle, wherein the spinning nozzle is joined to the connection piece by a quick-release coupling connection, particularly a bayonet coupling.

In one preferred embodiment, the filter element is detachably connected to the line of the connection piece.

In particular, the filter element is a metal wire filter, wherein the metal wire filter preferably has a mesh aperture of 10 to 40 $\mu$m, particularly of 10 to 20 $\mu$m.

The feed line is preferably detachably connected to the filter unit, e.g. for the cleaning and removal of the filter unit.

In particular, the mixer element is a static mixer, which is constructed as an insert in the filter unit, for example.

In one variant of the invention, the connection piece and/or the filter unit have a special adjustment means for the rapid adjustment of the spinning nozzle in the precipitation bath. After dismantling the apparatus, e.g. for cleaning purposes, this adjustment means makes reinstallation possible without special adjusting measures.

The adjustment means may consist of at least one recess or bore in the connection piece and/or in the filter unit, which cooperates with a correspondingly shaped peg of a holding device, which is mounted on the precipitation bath for example, which peg engages with a positive fit in the recess or bore.

The apparatus according to the invention is simple and rapid to manipulate, to clean and to replace and provides a considerably improved filament quality as well as an extended average nozzle service life, which inevitably results in an increased yield of product. On average, the nozzle service life of the apparatus according to the invention is more than 3 days, preferably 5 days or more.

The coefficient of variation of the titer of the elastane filaments obtained with the apparatus is less than 3, preferably less than 2, particularly less than 1 (R. Kaiser, G. Gottschalk, Elementare Tests zur Bearbeitung von Meβdaten (*Elementary Tests for the Processing of Measured Data*), B. I. Hochschultaschenbücher, Volume 774, page 60).

The spinning solution which enters the filter unit, and which is optionally premixed, is intensively mixed by the static mixer, so that what are termed solution strands of different temperature and viscosity, which are frequently formed on the pipe walls and bends of the spinning solution lines, are very substantially prevented or dispersed. A Type SMX mixer supplied by Sulzer, of Winterthur, Switzerland, has proved particularly useful as a static mixer. In the flowing spinning solution, the structure of a mixer comprising intersecting crosspieces causes a continuous rearrangement of the lines of flow from the pipe wall to the pipe centre and vice versa. Other suitable mixers are described by A. Heierle, A. Signer and R. Regez: "Static Mixers for the Chemical Industry" Chemiefasern/Textilindustrie 43/95th Volume Year, September 1993, pages 669–674. or in DE-A-2 822 096 and DE-A-2 522 106, for example.

The homogenised spinning solution is finely filtered via the filter element before the spinning solution is fed to the spinning nozzle. Filter candles made of metallic woven fabric supplied by the Fuji Filter Manufacturing Co. Ltd., of Tokyo, Japan, have proved particularly useful as the filter device. Due to this fine filtration, impurities and gel particles are separated from the spinning solution and the nozzle service life is thus considerably prolonged. A uniform viscosity and homogeneity of the spinning solution is ensured by a combination of these measures.

The provision of a two-stage filtration system for the spinning solution has proved to be particularly useful. This can be achieved by disposing what is preferably an even finer cloth filter (mesh aperture greater than or equal to 5 $\mu$m in particular, preferably greater than or equal to 10 $\mu$m) downstream of the first filter element, e.g. of the metal mesh wire filter, before the feed to the spinning nozzle.

In addition to the filtration according to the invention, the spinning solution can be pre-treated by methods which are known in principle, in order to achieve a defined solution viscosity for example. The spinning solution can also be subjected to a coarse preliminary filtration step upstream of the feed line, by means of conventional coarse filters, e.g. filter presses or plate filters comprising a metal sieve or a covering of cloth.

The present invention also relates to a process for the production of wet-spun elastane filaments having improved titer uniformity by spinning a spinning solution into a precipitation bath, washing the filaments formed, drying and fixing the filaments and optionally applying a preparation medium, which is characterised in that the spinning solution is spun into the precipitation bath via the spinning nozzle apparatus according to the invention.

Elastane filaments or fibres in the sense of the invention are those which comprise at least 85% by weight of polyurethanes or polyurethane-ureas, which have a segmented structure comprising hard and soft segments and which are soluble in customary solvents such as dimethylacetamide and dimethylformamide. Depending on the area of application of the fibres, customary polyester or polyether chains are incorporated in the polyurethane(-urea)s as the soft segments.

Other preferred embodiments of the invention, insofar as these are not cited above, are given in the dependent claims.

BRIEF DESCRIPTION OF THE DRAWINGS

The invention is explained in more detail below with reference to the Figures, where.

The following examples serve to elucidate the invention in greater detail, without themselves limiting the invention. Percentages are given as percentages by weight unless indicated otherwise.

EXAMPLES

Figure 1:
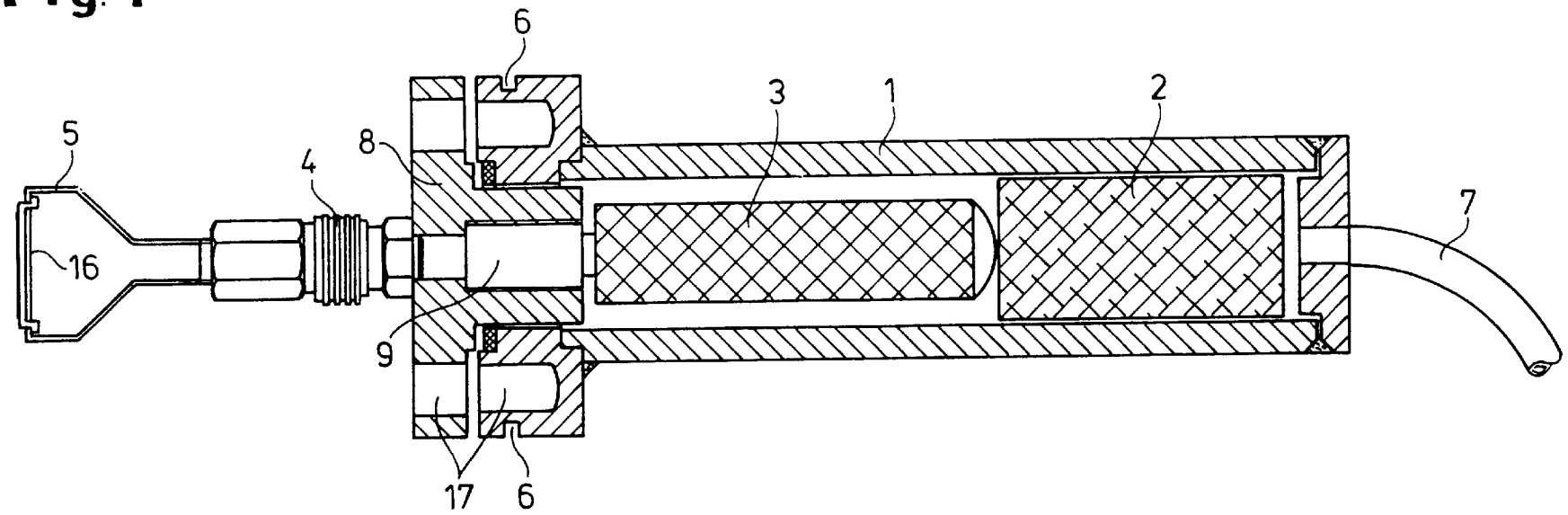
FIG. 1 is a cross-section through one embodiment of the spinning nozzle apparatus according to the invention.
Figure 2:
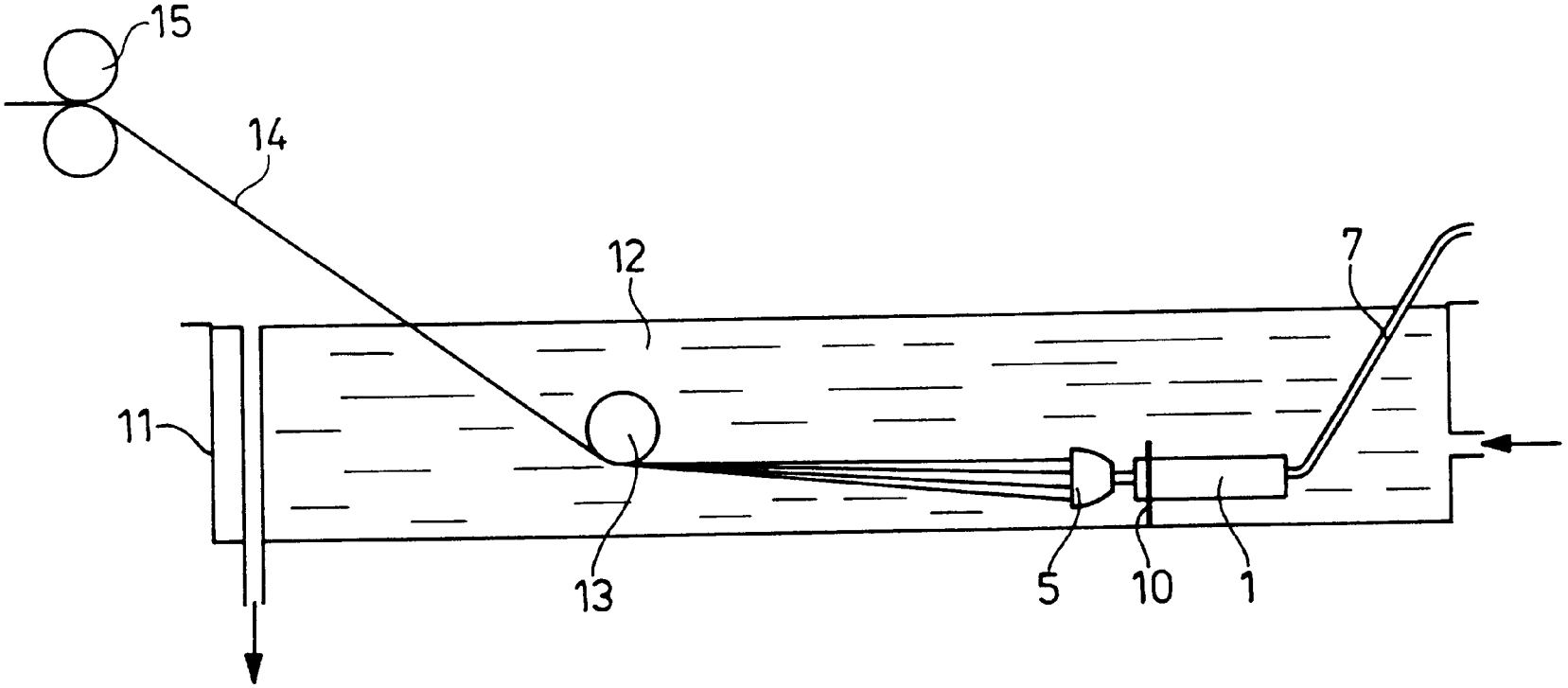
FIG. 2 is a diagram which illustrates the arrangement of the spinning nozzle apparatus shown in FIG. 1 in a precipitation bath 11.

The nozzle apparatus which is constructed as a "nozzle package" is shown in FIG. 1. It consists of a shaped cylindrical body 1 which contains stainless steel, and which contains a static mixer (Type SMK, Sulzer) and a filtration element 3, which is joined to the spinning nozzle 5 via the passageway 9 of a connection piece 8, with the aid of a quick-change bayonet coupling 4. The connection piece 8 and the shaped body 1 can be detachably joined at the bores 17 by means of threaded screws. At its outlet in the direction of the spinning nozzle 5 the shaped body 1 has recesses 6 which are employed for its rapid suspension in the pegs of a holding device 10 on the precipitation bath 11 and for adjusting the nozzle package in the precipitation bath 11 (see FIG. 2). Via a flexible hose connection 7, the entire apparatus is fashioned for feeding the spinning solution so that the entire nozzle package 1, 8, 5, including the spinning nozzle 5, can be replaced without problems within one minute if it is necessary to change the spinning nozzle. As a rule, there is a plurality of nozzle packages of this type which are disposed side by side or one above another in a precipitation bath 11 for the production of wet-spun elastane filaments. A fine cloth filter 16 with a mesh aperture of less than 10 $\mu$m is mounted just in front of the nozzle aperture 5.

Example 1

A 30% elastane spinning solution, prepared according to Example 7 of DE-OS 4 222 772, which had been pre-treated for about 10 minutes with 0.8% diethylamine at 130° C. and which had a spinning viscosity of 18 Pa.s at 70° C., was spun via the nozzle package, as described above, from a 40-orifice nozzle 5 into an aqueous precipitation bath solution 12 containing 15% by weight dimethylacetamide (DMAC) in the precipitation bath 11. A so-called "SMX mixer" supplied by Sulzer, Switzerland, was used as the static mixer 2 in the nozzle package. A cylindrical metal filter candle supplied by the Fuji Filter Manufacturing Co., Tokyo/Japan, which had a mesh aperture of 10 $\mu$m, was used as the filter 3. The precipitation bath temperature was 80° C. As described in DE-OS 4 446 340, Example 1, the filaments were pulled off via a deflection roller 13 and pull-off rollers 15, and moreover were subsequently treated as described in DE-OS 4 446 340. The take-up rate was 80 m/minute. The elastane filaments had a titer of 318 dtex for 40 individual filaments. The coefficient of variation of the titer was 0.89, as determined from 250 separate measurements. The nozzle 5 operated for 9 days overall. After a spinning period of 5 days, the nozzle 5 could be used again for spinning without problems after a 2-day interruption, after briefly washing it down with DMAC.

Example 2 (comparison)

A 30% elastane spinning solution was prepared and spun as described in Example 1. A conventional spinning apparatus (corresponding to an arrangement from US 35 26 689) was used instead of the nozzle package. The elastane filaments obtained had a titer of 316 dtex for 40 individual filaments. The coefficient of variation of the titer, which was again determined from 250 separate measurements, was 3.91. The nozzle 5 operated for 3.5 days overall. Individual torn-off filament portions in the form of so-called "smears" subsequently occurred in front of the nozzle. Coil formation and the formation of wound-on deposits occurred on the deflection roller 13 in the precipitation bath 11. Production had to be interrupted.

We claim:

1. A spinning nozzle apparatus for the production of elastane filaments from spinning solutions by the wet-spinning method, comprising a feed line (7) for the spinning solution, a filter unit (1) comprising a mixer element (2) and a filter element (3), a spinning nozzle (5) for immersion in a precipitation bath (11), and a connection piece (8) for the direct connection of the filter unit (1) and spinning nozzle (5), wherein the spinning nozzle (5) is joined to the connection piece (8) by a quick-release coupling connection (4).

2. An apparatus according to claim 1, wherein the filter element (3) is detachably connected to the line (9) of the connection piece (8).

3. An apparatus according to claim 1, wherein the filter element (3) is a metal wire filter.

4. An apparatus according to claim 3, wherein the metal wire filter has a mesh aperture of 10 to 40 $\mu$m.

5. An apparatus according to claim 1, wherein the feed line (7) is detachably connected to the filter unit (1).

6. An apparatus according to claim 1, wherein the mixer element (2) is a static mixer.

7. An apparatus according to claim 1, wherein the connection piece (8) and/or the filter unit (1) have an adjustment means (6) for the rapid adjustment of the spinning nozzle (5) in the precipitation bath (11).

8. An apparatus according to claim 7, wherein the adjustment means (6) is at least one recess or bore in the connection piece (8) and/or in the filter unit (1), in which a peg of a holding device (10) mounted on the precipitation bath (11) engages with a positive fit.

9. A process for the production of wet-spun elastane filaments having improved titer uniformity which comprises forming filaments by spinning a spinning solution into a precipitation bath, washing the filaments formed, drying and fixing the filaments and optionally applying a preparation medium, wherein the spinning solution is spun into the precipitation bath via an apparatus according to claim 1.

10. The apparatus of claim 1, wherein said quick-release coupling connection is a bayonet coupling.

11. The apparatus of claim 4, wherein said mesh aperture is 10 to 20 $\mu$m.

12. The apparatus of claim 6, wherein said static mixer is constructed as an insert.

* * * * *